United States Patent [19]

Blancha

[11] 3,995,966

[45] Dec. 7, 1976

[54] CHECK VALVE FOR A DOUBLE ACTION PUMP

[75] Inventor: Erwin B. Blancha, Sterling Heights, Mich.

[73] Assignee: General Motors Corporation, Detroit, Mich.

[22] Filed: Feb. 21, 1975

[21] Appl. No.: 551,548

[52] U.S. Cl. ..... 417/254; 417/559; 417/489

[51] Int. Cl.[2] ..... F04B 3/00; F04B 7/04; F04B 39/10

[58] Field of Search ..... 417/260, 262, 254, 554, 417/489, 559

[56] References Cited

UNITED STATES PATENTS

| | | | |
|---|---|---|---|
| 1,575,250 | 3/1926 | Brittain | 417/260 |
| 2,122,020 | 6/1938 | Barks | 417/489 |
| 2,636,441 | 4/1953 | Woelfer | 417/260 |
| 2,787,225 | 4/1957 | Rotter | 417/489 |
| 3,312,178 | 4/1967 | Rotter | 417/254 |
| 3,814,553 | 6/1974 | Hubschmann | 417/511 |

*Primary Examiner*—William L. Freeh
*Attorney, Agent, or Firm*—Donald F. Scherer

[57] ABSTRACT

Double action piston pumps incorporate a check valve mechanism to control material flow between the pumping chambers and the pump outlet. The present disclosure includes an improved check valve mechanism which is mounted in the pump in free floating relation with the pump piston to permit more efficient closing of the check valve and therefore provide more efficient and consistent output flows. This check valve has an inner annular surface surrounding the pump piston and is separated therefrom by a clearance of between .035 and .085 inches. When the check valve is closed, during part of the pumping cycle, it seats on an improved valve plate thereby preventing a reversal of flow. The valve plate on which the check is seated is in a close dimensional tolerance with the piston rod to effectively scrape the piston rod clean thereby preventing the adhesion of the material being pumped to the piston rod.

2 Claims, 4 Drawing Figures

CHECK VALVE FOR A DOUBLE ACTION PUMP

This invention relates to improvements in double action piston pumps and more particularly to an improved check valve assembly incorporated in such pumps.

Prior art double action piston pumps, such as that shown in U.S. Pat. No. 3,610,105, are effective to pump material in both directions of piston stroke. The operation of these pumps is well known and it is also well known that a valve arrangement must be provided between the pumping chambers to effectively control the material flow. It is necessary for these pumps to be able to operate efficiently through a wide range of material viscosities. These pumps must be able to distribute low viscosity fluids such as water, and more highly viscous materials such as urethane sealing compounds. In the prior art pumps, such as that shown in U.S. Pat. No. 3,160,105, the control check valve is subject to adhering to the piston of the pump during the pumping operation and this greatly reduces the pumping efficiency.

The present invention corrects this problem by providing substantial clearance between the check valve and the piston rod and also by utilizing the check valve plate as a piston scraper. Because of the large clearance between the valve and the piston, large size pieces of grit cannot become wedged therein to prevent the free floating condition occasioned by this invention. Also to this end the valve plate acting as a scraper reduces the likelihood of adhesive materials such as urethane sealers adhering to the piston when they are being pumped.

It is an object of this invention to provide an improved double action reciprocating piston pump having an improved check valve for controlling the flow of material between the pumping chambers.

It is another object of this invention to provide in an improved double action piston pump and improved check valve encircling a portion of the piston and wherein said check valve has a substantial diametral clearance with said piston.

A further object of this invention is to provide in a double acting piston pump an improved check valve and valve plate structure wherein the check valve encircles the piston with substantial clearance to promote free floating of the check valve and wherein the valve plate is in close sliding tolerance with the piston to provide a surface cleaning action on the piston.

These and other objects and advantages of the present invention will be more apparent from the following description and drawings wherein.

Figure 1:
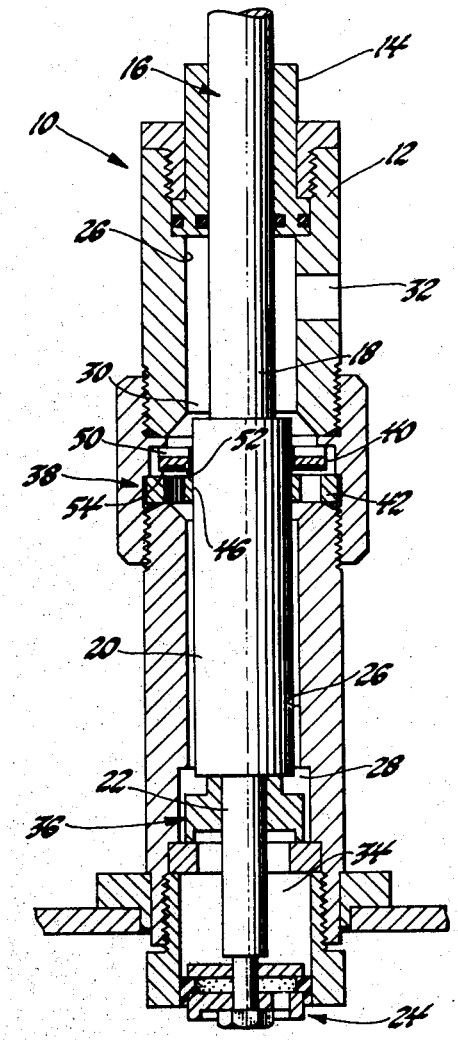
FIG. 1 is a cross sectional elevational view of a pump incorporating the present invention.
Figure 3:
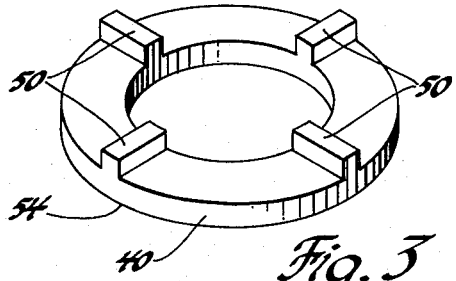
FIG. 3 is a isometric view of the check valve.

Referring to the drawings, wherein like characters designate the same or corresponding parts throughout the several views there is seen in FIG. 1 the pump 10 having a housing 12 in one end of which is secured a bushing 14. The bushing 14 slidably supports a piston rod 16 having three cylindrical piston portions 18, 20 and 22. The piston rod 16 may be driven by any of commercially available drive motors.

The cylinder portion 22 has secured thereon a primer check valve assembly 24 which is slidably disposed in the housing 12 and is effective in cooperation with bushing 14 to maintain the piston rod 16 aligned within the central bore 26 of the housing 12. The piston bore 26 and cylinder portions 20 and 22 cooperate to form a lower pumping chamber 28. An upper pumping chamber 30 is formed through the cooperation of the cylinder bore 26 and the cylindrical portions 18 and 20. As can be seen the cylindrical portion 18 is of larger diameter than cylindircal portion 22 and of smaller diameter than portion 20. Therefore chamber 28 is larger than chamber 30. Preferably chamber 28 is twice as large as chamber 30 such that substantially constant material flow from the pump outlet 32 can be accomplished when the piston 16 is being stroked in either direction. The primer check assembly 24 and the cylinder bore 26 cooperate with the cylindrical portion 22 to form a primer chamber 34 which is effective to move material past a lower check valve assembly 36 into the lower chamber 28.

When the piston 16 is moved downward as viewed in FIG. 1, the check valve 36 closes so that material in chamber 28 is forced past a check valve assembly 38 into the upper chamber 30. As previously mentioned upper chamber 30 is approximately one half the volume of chamber 28 such that half of the material displaced from chamber 28 fills the expanding chamber 30 and the remainder of the material must be exhausted through outlet 32. When the piston rod 16 is moved upwardly, chamber 30 is contracting and the chamber 28 is expanding. To prevent the flow of material from chamber 30 reentering chamber 28, the check valve assembly 38 closes due to the pressure increase in chamber 30. Therefore all of the material in chamber 30 is discharged through outlet 32. Also when the piston rod 16 is moving upwardly the material in primer chamber 34 is pumped past the check valve 36 by the primer check valve assembly 24 thus refilling chamber 28. A more complete description of the operation of this pump can be found in U.S. Pat. No. 3,160,105.

Figure 4:
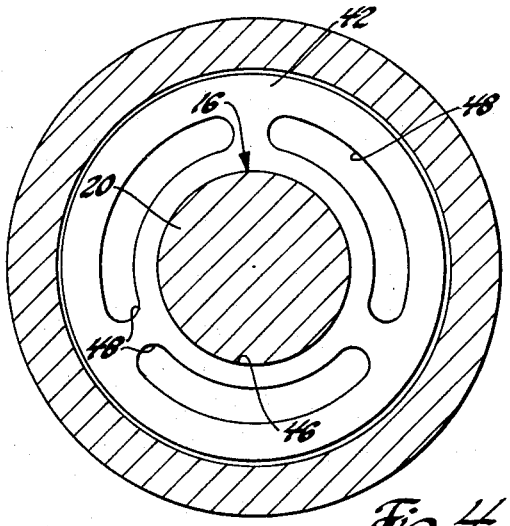
FIG. 4 is a view taken along line 4—4 of FIG. 2.
Figure 2:
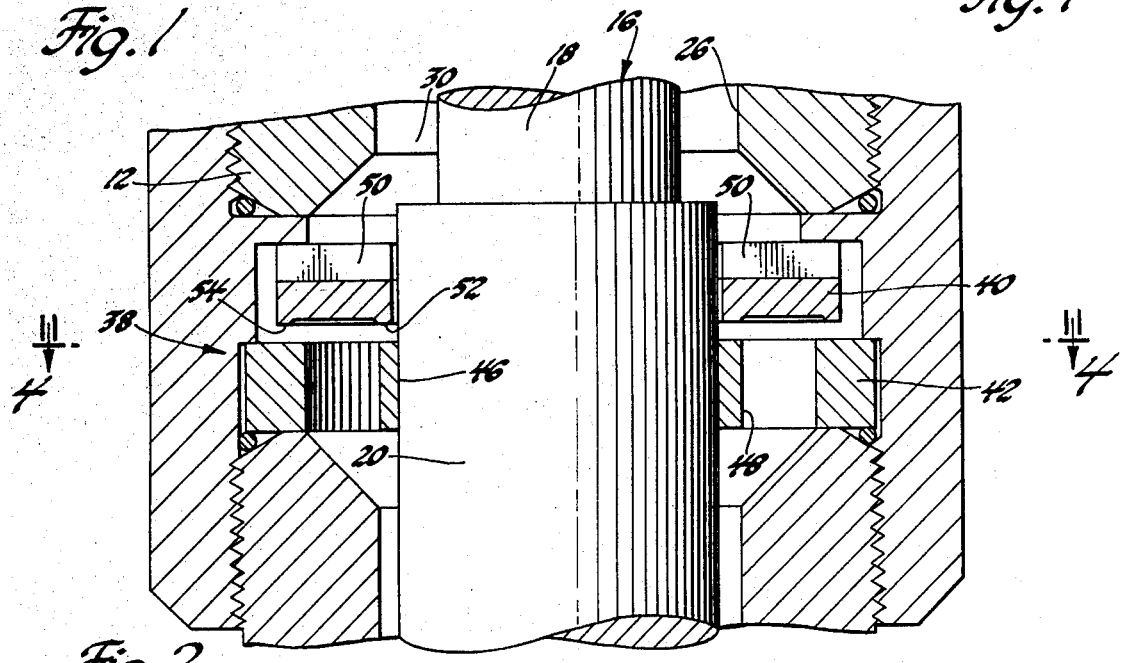
FIG. 2 is a partial sectional view of a portion of the pump showing the improved check valve structure.

Referring to FIG. 2 wherein the check valve assembly 38 is shown enlarged, it is seen that the check valve assembly 38 includes a check valve 40 and a valve plate 42. The valve plate 42 is annular in shape and is secured in the housing 26 to prevent movement of the plate 42 relative thereto. The plate 42 has an inner cylindrical surface 46 which is in close tolerance sealing relationship with the piston portion 20. Preferably this tolerance is approximately .001 inch on the diameter. This close tolerance prevents the adhesion of the material being pumped to the surface of cylinder piston portion 20. As can be seen in FIG. 4 the valve plate 42 has a plurality of kidney shaped openings 48 which permit the flow of material from the lower chamber 28.

The check valve 40 is also an annular shaped component and has formed thereon a plurality of lugs 50. As seen in FIG. 2, material flowing from chamber 28 through the kidney openings 48 of plate 42 is directed between the inside diameter of housing 12 and the outside diameter of check valve 40 and then between the lugs 50 to the chamber 30. The check valve 40 also has a pair of annular surfaces 52 and 54 which are adapted to seat against valve plate 42 to seal the openings 48 thereby preventing communication from upper chamber 30 to lower chamber 28 when the pumping cycle is reversed. It should also be noted that there is substantial clearance between the inside diameter of check valve 40 and the outer diameter of cylindrical surface 20. This is a very important part of the present invention since it permits the check valve 40 to be free floating within the housing 26 relative to the piston 16. Preferably this clearance is a diametral clearance of between 0.035 and 0.085 inches. In most assemblies it has been found that a clearance of 0.060 inches is satisfactory to permit the pumping of both low and high viscosity material.

As can be appreciated from the previous description of the pumping operation, when the piston 16 is moving downwardly the check valve 40 must move upwardly and vice versa. Prior art pumps were found to have a drawback in that the check valve arrangement was likely to adhere to the piston for a portion of the pumping stroke, when more viscous materials are pumped, thereby greatly reducing the pumping efficiency. With the utilization of the present invention, however, the check valve 40 responds rapidly to the change in pressure development which occurs during the change of pump cycle to immediately open or close communication between the chambers 28 and 30 as desired. Thus the pumping efficiency is greatly improved. It has also been found that by incorporating the present invention the range of viscosities which can be pumped is also greatly improved thus extending the usefulness of pumps of this type.

What is claimed is:

1. An improvement in a double action reciprocating piston pump having a reciprocable piston operatively disposed in two pump chambers, a primer chamber, valve means for controlling flow from said primer chamber to one of said pump chambers and a check valve for controlling the flow between the chambers wherein said check valve moves in a direction opposite to the movement of the piston of said pump when opening or closing to control flow; the improvement comprising; a free floating check valve means for controlling flow from one pump chamber to the other pump chamber when the one pump chamber is pumping and for providing substantially free flow between the chambers when the other chamber is pumping, said check valve having an inner cylindrical surface encircling the pump piston and being spaced therefrom by a diametral clearance of 0.035 to 0.085 inches and an outer cylindrical surface having a clearance with the inner wall of said pump, and valve plate means adjacent one side of said check valve means and cooperating therewith for controlling flow and having an inner cylindrical surface in close sliding fit with said piston for scraping foreign matter from said piston as piston is reciprocating and port means radially outward of the inner cylindrical surface thereof for providing a split flow to the inner and outer cylindrical surfaces of said check valve means.

2. An improvement in a double action reciprocating piston pump having a reciprocable piston operatively disposed in two pump chambers a primer chamber, valve means for controlling flow from said primer chamber to one of said pump chambers and a check valve for controlling flow between the chambers wherein said check valve moves in a direction opposite to the movement of the piston of said pump when opening or closing to control flow; the improvement comprising: a free floating check valve means for preventing flow from one pump chamber to the other pump chamber when the one pump chamber is pumping and for providing substantially free flow between the chambers when the other chamber is pumping, said check valve having an inner surface encircling the pump piston and being spaced therefrom by a diametral clearance of substantially 0.060 inches and an outer cylindrical surface having a clearance with the inner wall of said pump; and valve plate means adjacent one side of said check valve means and cooperating therewith for controlling flow and having an inner cylindrical surface in close sliding fit with said piston for scraping foreign matter from said piston when said piston is reciprocating and port means radially outward of the inner cylindrical surface thereof for providing a split flow to the inner and outer cylindrical surfaces of said check valve means.

* * * * *